US006102387A

United States Patent [19]

Zerfahs

[11] Patent Number: 6,102,387

[45] Date of Patent: Aug. 15, 2000

[54] AUTOMATED SHEET DISPENSER

[75] Inventor: Arthur S. Zerfahs, Elk Grove, Ill.

[73] Assignee: General Railway Signal Corporation, Rochester, N.Y.

[21] Appl. No.: 08/812,661

[22] Filed: Mar. 7, 1997

[51] Int. Cl.[7] ..... B65H 3/08

[52] U.S. Cl. ..... 271/99; 271/103; 271/102; 271/106; 271/100

[58] Field of Search ..... 271/99, 100, 102, 271/103, 106

[56] References Cited

U.S. PATENT DOCUMENTS

| | | | |
|---|---|---|---|
| 1,756,395 | 4/1930 | Spence, Jr. | 271/102 |
| 1,886,102 | 11/1932 | Jahne | 271/100 |
| 3,071,369 | 1/1963 | Ambrogi | 271/101 |
| 3,181,860 | 5/1965 | Liebenow et al. | 271/32 |
| 3,458,042 | 7/1969 | Mestre | 271/100 |
| 3,934,868 | 1/1976 | Selak | 271/100 |
| 4,155,546 | 5/1979 | Jacobs | 271/100 |
| 4,369,962 | 1/1983 | Spiro | 271/100 |
| 4,463,942 | 8/1984 | Newsome | 271/12 |
| 4,621,800 | 11/1986 | Bauer et al. | 271/11 |

FOREIGN PATENT DOCUMENTS

| | | | |
|---|---|---|---|
| 4140079 | 12/1991 | Germany | 271/100 |
| 52-33267 | 3/1977 | Japan | 271/100 |
| 1437749 | 6/1976 | United Kingdom | 271/100 |

*Primary Examiner*—William E. Terrell
*Assistant Examiner*—Patrick Mackey
*Attorney, Agent, or Firm*—Ohlandt, Greeley, Ruggiero & Perle

[57] ABSTRACT

An automated sheet dispenser for dispensing a single sheet removed from the bottom of a stack formed of a plurality of sheets. The dispenser includes a hopper for supporting the stack of sheets, the hopper having an opening provided in the bottom surface thereof to allow passage of a sheet through the opening; a separator for separating a leading edge of the bottom sheet from the stack through the opening and moving the leading edge to a position below the hopper; and a guide for engaging the leading edge of the sheet separated from the stack by the separator and guiding the sheet to a sheet exit chute. The separator is lowered from the stack to separate the leading edge of the bottom sheet and the guide pivots to engage the leading edge and guide the leading edge between a pair of feed rollers that transport the sheet to the exit chute. The lowering of the separator, the pivoting of the guide and the advancing of the gripping feed roller are actuated by rotation of a main cam.

12 Claims, 7 Drawing Sheets

AUTOMATED SHEET DISPENSER

The present invention is directed to a device for separating a single sheet article from the bottom of a stack of similar sheet articles, and dispensing the single sheet article from the device. More particularly, the present invention is directed to a feeding mechanism for feeding a single card, such as an adhesive-backed postal stamp card, from a stack of such cards, using a device in which all feeding and dispensing components are actuated via one complete rotation of a single egg-shaped cam member.

BACKGROUND OF THE INVENTION

Devices that use a vacuum suction cup, or a plurality of vacuum suction cups, to separate the bottom most sheet article from a stack formed of a plurality of like sheet articles in a gravity fed hopper are known. The use of vacuum means, alone, to separate the bottom sheet from a stack of sheets has been found disadvantageous, however, as the leading edge of the separated bottom sheet cannot be consistently guided to the feed rollers used to transport the separated sheet from the device, thereby causing the jamming of the device.

The use of various guide means for guiding the leading edge of the separated sheet to a feed means for feeding the separated sheet from the device is also known. Devices employing such guide means, however, have required the use of a number of control members and sensors to coordinate the movement of the separator means and guide means, to insure that the components operated in a synchronized manner. As a result, such devices contain a number of relatively delicate parts that are easily moved out of alignment in use, are bulky, complex and expensive to produce and maintain.

Accordingly, it is an object of the present invention to provide a device that overcomes the aforementioned problems. More specifically, it is the object of the invention to provide a device that can effectively separate the bottom sheet from a stack of sheets, and guide the separated sheet from the device for dispensing, the device having a minimal number of parts, and requiring no sensors to synchronize the operation of the separating means and guide means. It is a further object of the invention to provide such a device in which movement of the separating means and guide means are controlled by a single, common cam, thereby simplifying the construction of the device, while insuring synchronous operation of the various components.

SUMMARY OF THE INVENTION

The present invention is directed to an automated sheet dispenser for dispensing a single sheet removed from the bottom of a stack formed of a plurality of sheets. The device of the invention includes a hopper for supporting the stack of sheets, a bottom surface of the hopper being provided with an opening through which a sheet can be withdrawn. A separating means is provided for separating a leading edge of the bottom sheet from the stack, and partially withdrawing the bottom sheet through the opening in the hopper bottom. Upon withdrawal of the leading edge of the sheet from the hopper, a guide means is pivoted from an initial position to engage the leading edge of the separated sheet, and guide the leading edge toward an exit chute. Advantageously, the leading edge is first guided to a nip portion formed between opposed feed rollers to assist in the transport of the separated sheet from the device.

The movement of each of the separating means, the guide means, and the feed rollers, is controlled by a single common egg-shaped cam member and associated cam followers. A single cycle, including the separation of the sheet from the stack by the separating means, the guiding of the separated sheet to the feed rollers, the pivoting of the feed rollers toward each other to provide transport of the sheet, ejection of the sheet from the device, and the return of all components to an initial position is accomplished in a single 360 degree rotation of the cam member.

DESCRIPTION OF THE PREFERRED EMBODIMENT

Figure 1:
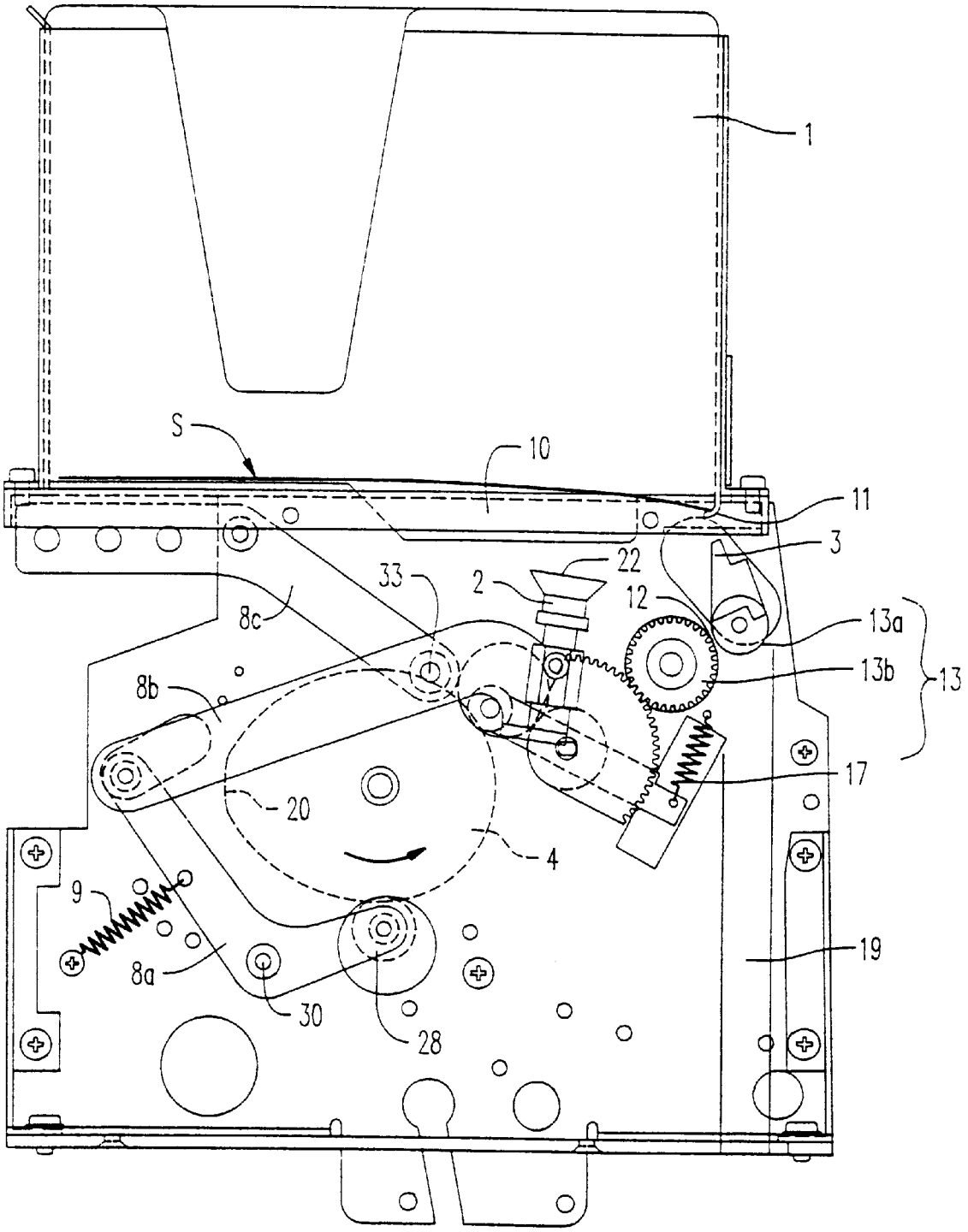
FIG. 1 shows the device in an initial position in which the separating means and guide means are in their respective rest positions.

With reference to FIG. 1, a preferred embodiment of the present invention comprises a hopper 1 for supporting a stack of sheets, a separating means 2 and a guide means finger 3, each of separating means 2 and guide means finger 3 being movable by rotation of main cam 4. The sheets, for example, adhesive-backed postal stamp sheets attached to a backer card, are stacked stamp-side up in hopper 1, e.g., a vertical column gravity feed hopper. Hopper 1 is provided with an opening 10 in the lower surface through which the sheets can be withdrawn. The forward edge of the bottom surface of hopper 1 is preferably provided with a lip 11 for supporting the leading edge of the bottom sheet prior to separation of the bottom sheet from the stack of sheets.

Figure 7:
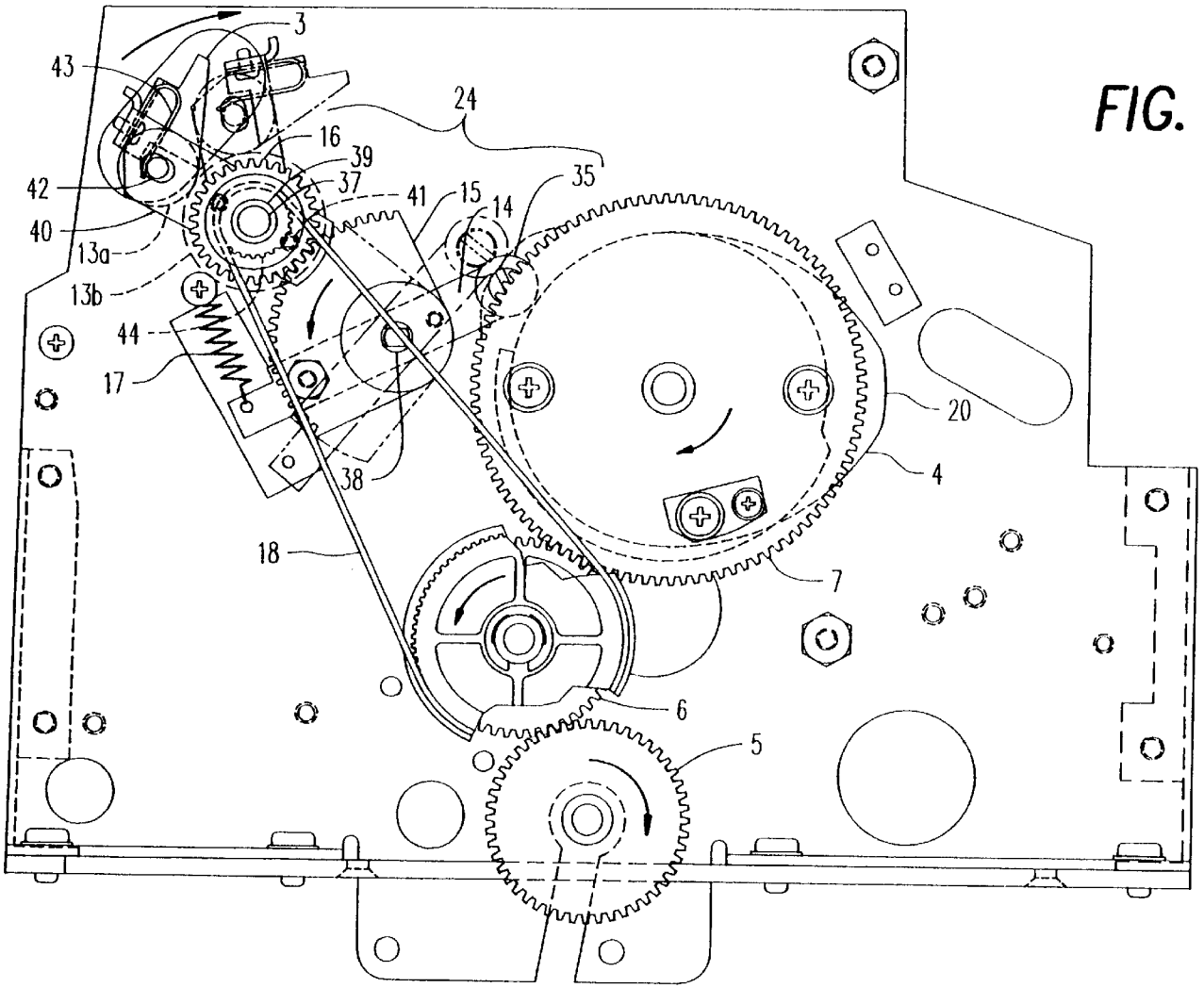
FIG. 7 shows a view from the opposite side of the device, wherein all components of the device are in their respective initial rest positions, illustrating the means by which the main cam and feed rollers are rotated by the drive motor.

Upon receiving a signal from a main machine or money acceptor device (not shown), an electric current is sent to a drive motor (not shown) which causes main cam 4 to rotate via drive motor gear 5, intermediate gear 6 and main cam gear 7 (shown in FIG. 7). Upon rotation, high lobe 20 of main egg-shaped cam 4 contacts separating means linkage (8*a*, 8*b*, 8*c*) to raise separating means 2 toward bottom sheet S of the stack of sheets, against the force of separating means retractor spring 9. At the same time, the drive motor rotates a second switch cam (not shown) to actuate a vacuum pump (not shown) to apply a vacuum to vacuum suction cup 22 of separating means 2.

Separating means linkage (8*a*, 8*b*, 8*c*) includes a first cam follower 28 disposed on a first end of first arm 8*a* which is pivotal about first pivot point 30, and a second arm 8*b* pivotably attached to a second end of first arm 8*a*. Separating means 2 is provided on an end of second arm 8*b*, distal from first arm 8*a*. Separating means linkage (8*a*, 8*b*, 8*c*) further includes a third arm 8*c*, a central portion of which is pivotably attached to the device proximal hopper 1, and one end of which is pivotably attached to second arm 8*b* to provide a second pivot point 33. Retractor spring 9 is attached to first arm 8*a*.

Figure 2:
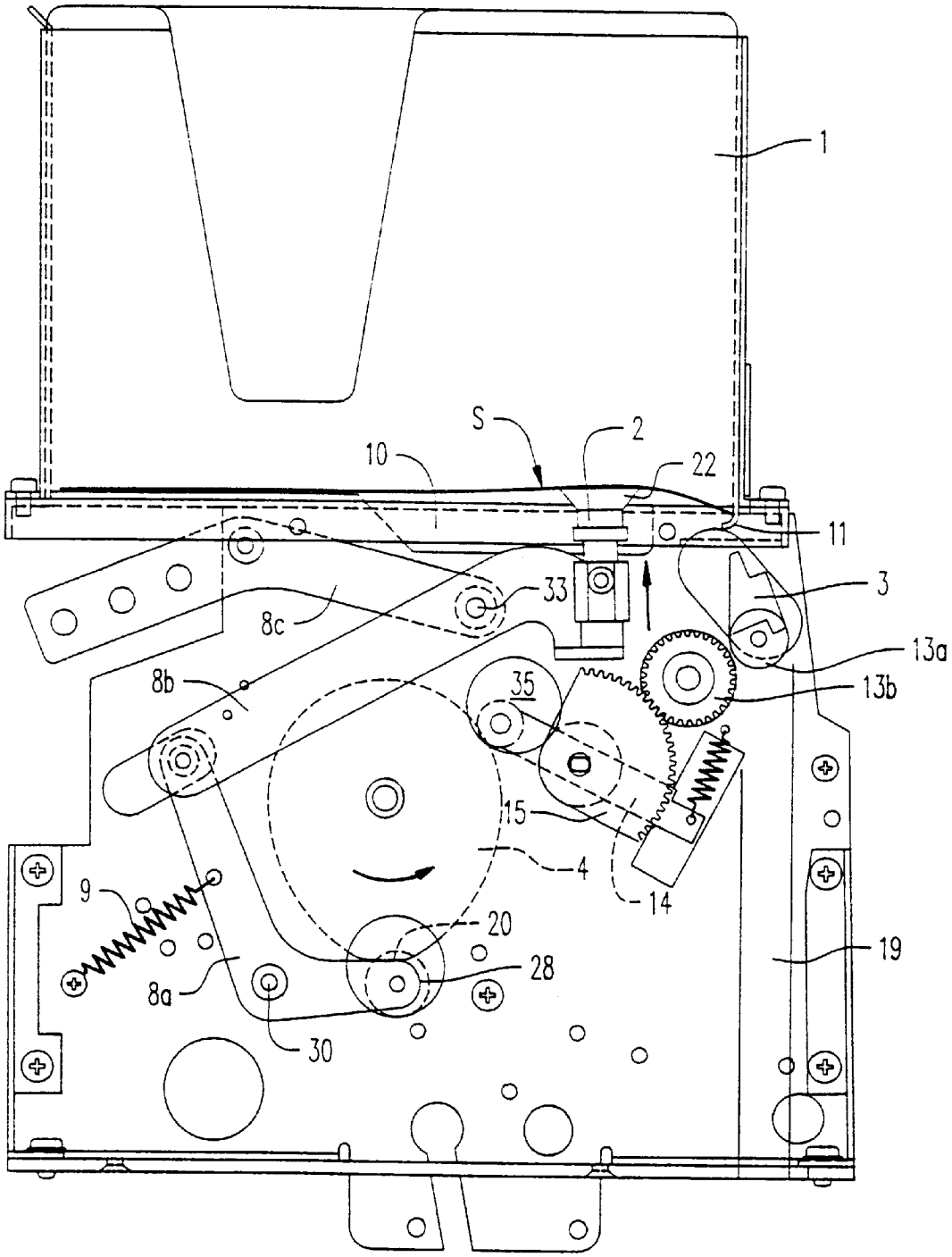
FIG. 2 shows the device after a 90° rotation of the cam, wherein the vacuum separating means has contacted the bottom sheet of the stack of sheets.
Figure 3:
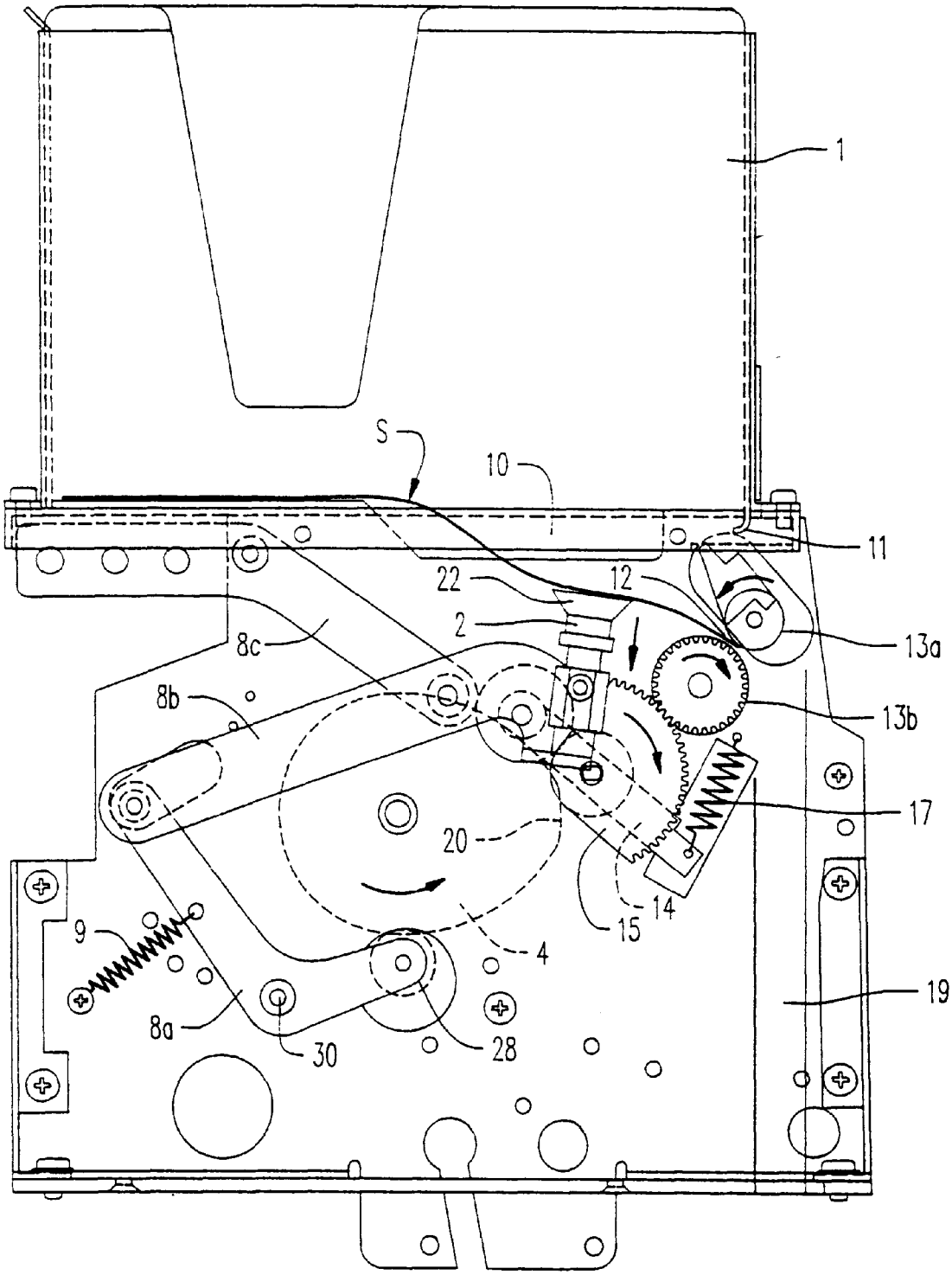
FIG. 3 shows the device after a 180° rotation of the cam, wherein the vacuum separating means has withdrawn the leading edge of the bottom sheet from the hopper and the guide means has pivoted to engage and guide the leading edge between the exit rollers.
Figure 4:
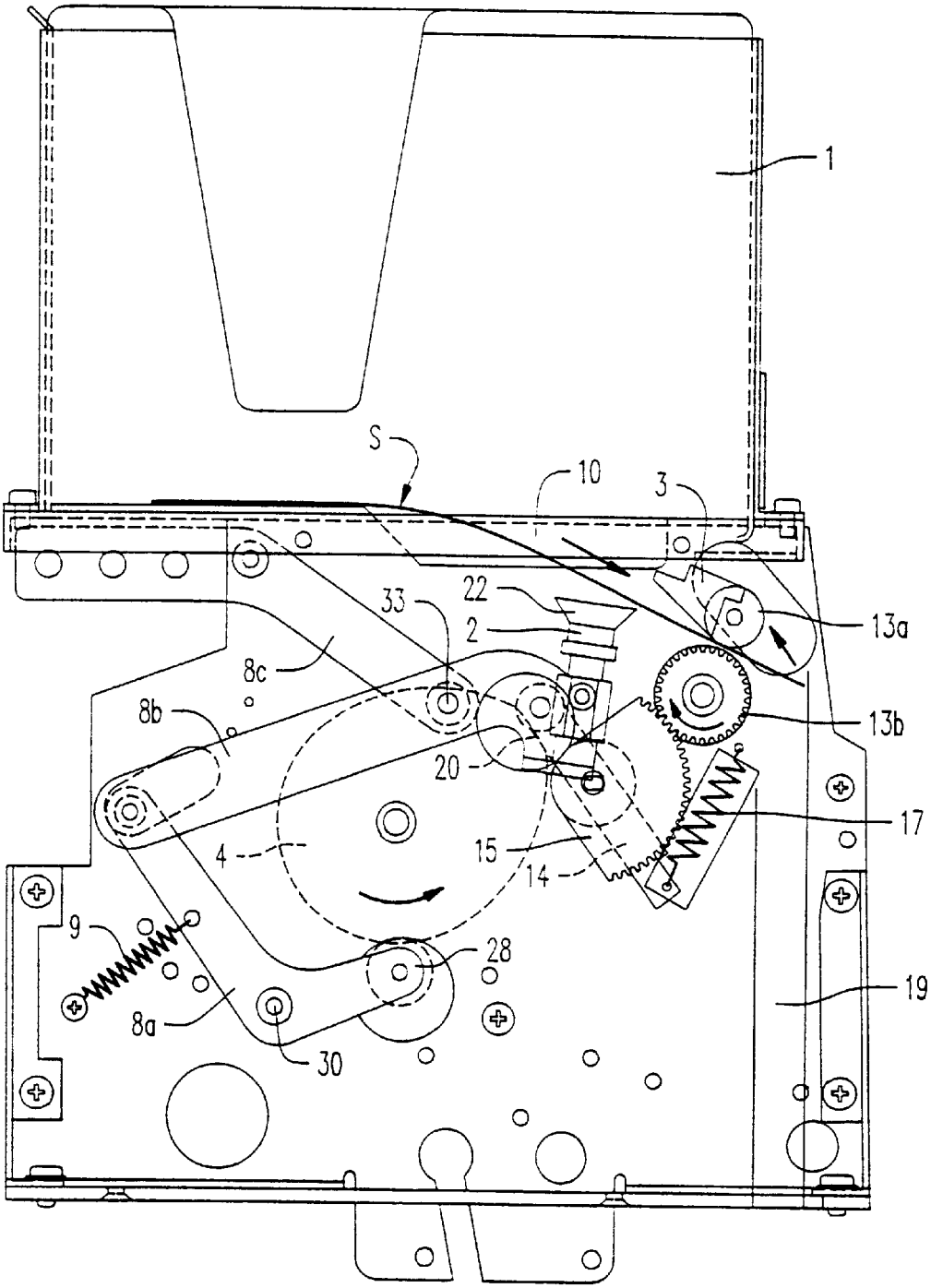
FIG. 4 shows the device after a 220° rotation of the cam, wherein the separating means separates from the withdrawn sheet and the exit roller advance mechanism has been activated to pivot the upper exit roller toward the sheet to transport the sheet to the exit chute.

In FIG. 2, a vacuum suction cup 22 provided on separating means 2 contacts bottom sheet S after rotation of main cam 4 about 90° from the rest or initial position and is temporarily adhered to the sheet by the applied vacuum. As shown in FIG. 3, upon rotation of main cam 4 through about 180° from the rest position, separating means linkage (8*a*, 8*b*, 8*c*) lowers vacuum cup 22 of separating means 2 which, in turn, pulls bottom sheet S past lip 11 and through opening 10. As sheet S is pulled through opening 10, further rotation of main cam 4 simultaneously pivots guide means finger 3 downward to trap and guide a substantial portion of the leading edge of sheet S to a nip portion 12, formed between exit feed rollers 13.

As shown in FIG. 7, guide means finger 3 is pivoted by cam 4 rotating in a clockwise direction. Upon clockwise rotation of cam 4, high lobe 20 engages cam follower 35, which is mounted on exit roller arm 14, thereby causing exit roller arm 14 to pivot about shaft 38 in a counter-clockwise direction. Quarter section gear 15 is attached to exit roller arm 14 and pivots about shaft 38 with exit roller arm 14. Quarter section gear 15 meshes with gear 16 so that rotational motion is transferred between quarter section gear 15 and gear 16. Gear 16 rotates about the outside diameter of stationary drive shaft bearing 39. Guide means finger 3 is attached to guide means frame 40 which, in turn, is attached to gear 16 via screws 41. Guide means finger 3 preferably pivots about bearing 39 along with gear 16. Thus, the actuation of cam follower 35 by high lobe 20 results in the pivoting of guide means finger 3 in a clockwise direction to engage the leading edge of sheet S, as shown in FIG. 7. As the leading edge of sheet S is trapped by guide means finger 3, the vacuum pump is shut off by the second cam, which releases sheet S from vacuum suction cup 22 of separating means 2. This allows sheet S to be pulled freely by exit feed rollers 13.

Exit feed rollers 13, including upper pressure roller 13*a* and lower drive roller 13*b* are also mounted to guide means frame 40. Lower drive roller 13*b* is rotated continuously about shaft 37 by pulley 44 which is driven by drive motor gear 5 via timing belt 18 whenever power is provided to the drive motor. Upper pressure roller 13*a* is pressed tightly against lower drive roller 13*b* by two leaf springs 43 disposed between upper pressure roller 13*a* and shaft 42. Both upper pressure roller 13*a* and lower drive roller 13*b* rotate together because of the spring pressure from leaf springs 43,. The pressure between exit feed rollers 13 provides the grabbing force that pulls bottom sheet S from hopper 1.

Whenever guide means finger 3 pivots to guide the leading edge of sheet S into exit roller nip 12 upper pressure roller 13*a* is moved toward sheet S to capture the leading edge thereof Bottom sheet S is then pulled by exit feed rollers 13 and transported through exit chute 19.

Returning to FIG. 2, rotation of main cam 4 results in the following: (1) it causes high lobe 20 to contact first cam follower 28 causing first arm 8*a* to pivot around first pivot point 30 thereby moving second arm 8*b* toward hopper 1; and (2) it pivots separating means 2 around second pivot point 33 such that it comes into contact with sheet S against the force of retractor spring 9.

Figure 5:
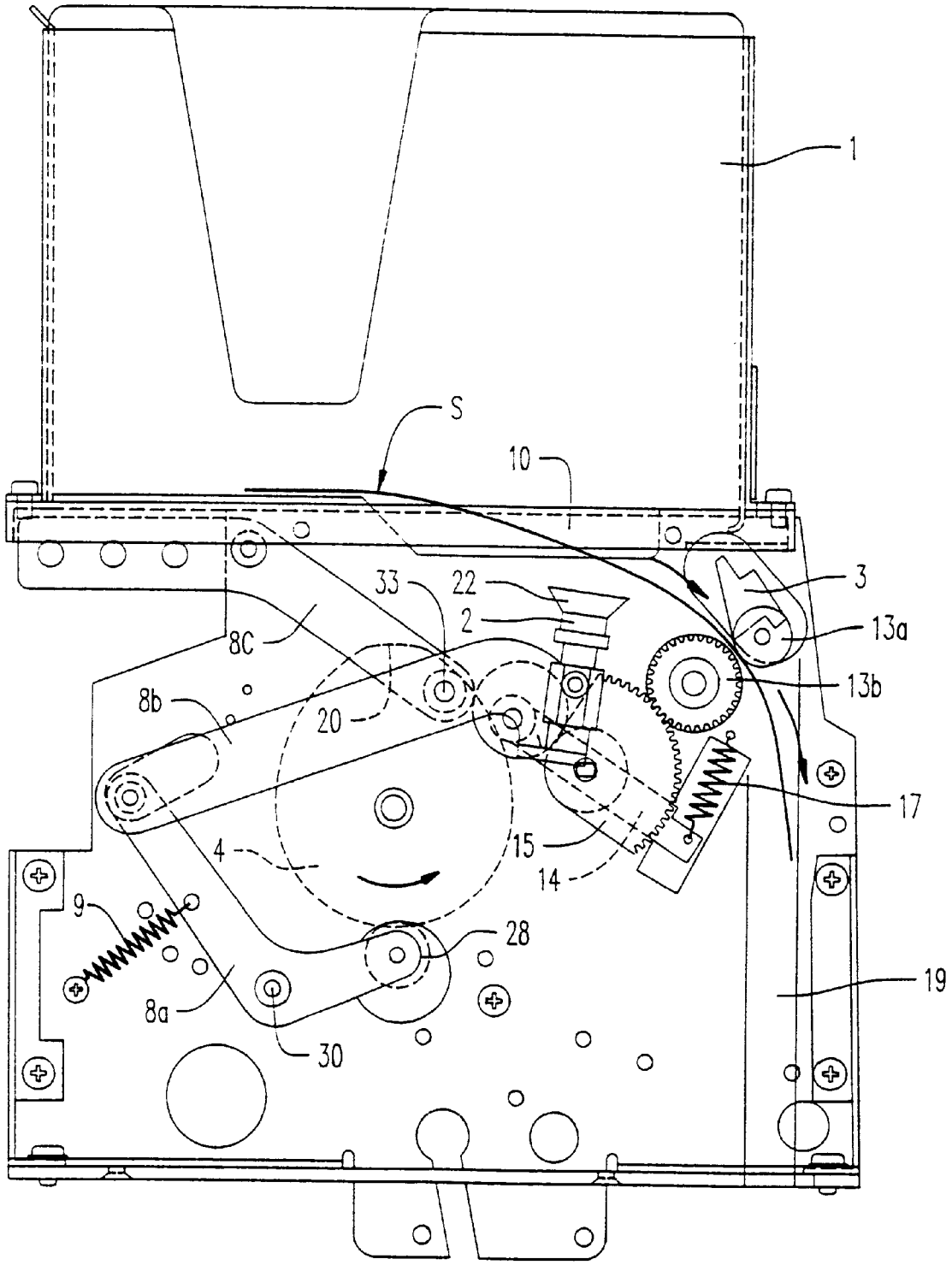
FIG. 5 shows the device after a 270° rotation of the cam, wherein the exit roller advance mechanism retracts while the exit rollers continue to feed the sheet toward the exit chute.
Figure 6:
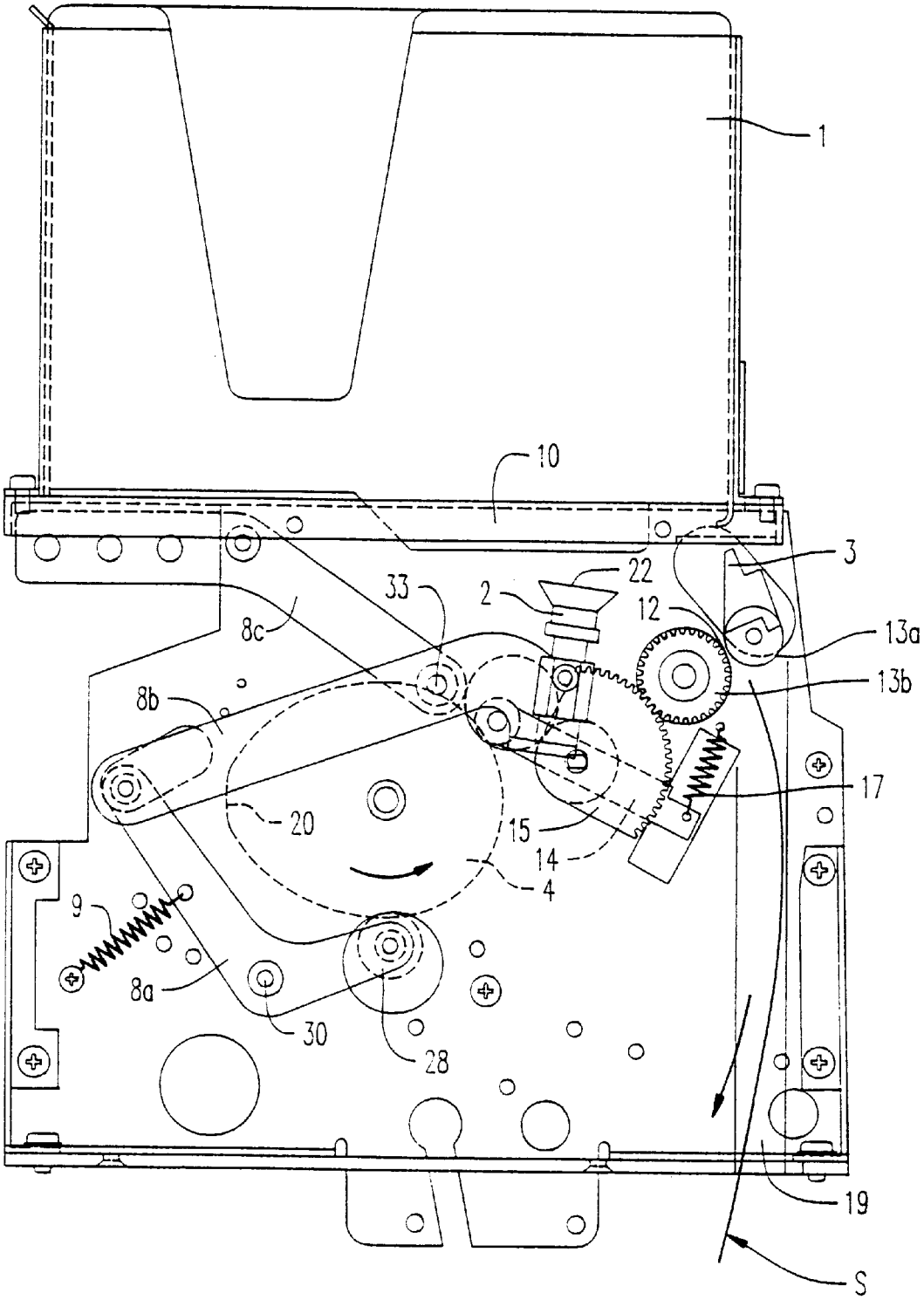
FIG. 6 shows the device after a 360° rotation of the cam, wherein all components of the device have been returned to their respective rest positions, the drive means and vacuum means have been switched off, and the sheet is dispensed through the exit chute.

As shown in FIG. 5, upon rotating about 270° high lobe 20 is brought out of engagement with exit roller arm 14 such that exit roller advance mechanism 24 retracts under the force of retraction spring 17 while exit rollers 13 continue to rotate such that sheet S is transported to exit chute 19. Upon completion of a single rotation of 360°, as shown in FIG. 6, each of main cam 4, separating means 2 and guide means finger 3 return to their respective rest or initial positions; wherein sheet S has completely passed through exit feed rollers 13 and falls via gravity through exit chute 19 to be delivered to the consumer. The cycle is now complete, and both the drive motor and vacuum pump are rendered inactive.

While a preferred embodiment in accordance with the invention has been shown and described, it is to be clearly understood that the same are susceptible to numerous changes apparent to one of ordinary skill in the art. Therefore, the invention should not be deemed to be limited to the details shown and described above, and should be considered to show all changes and modifications which come within the scope of the appended claims.

What is claimed is:

1. An automated sheet dispenser for dispensing a single sheet removed from the bottom of a stack formed of a plurality of sheets, said dispenser comprising:

a hopper for supporting the stack of sheets, said hopper having an opening provided in the bottom surface thereof to allow passage of a sheet through said opening;

a separating means for separating a leading edge of said single sheet from said stack through said opening and moving said leading edge to a position below said hopper;

a guide means for engaging said leading edge of said single sheet separated from said stack by said separating means, and guiding said single sheet to a sheet exit chute; and a main cam operatively engaged with said separating means and said guide means which lowers said separating means from the stack to separate said leading edge of said single sheet and pivots said guide means to engage said leading edge of said single sheet.

2. The dispenser of claim 1, wherein a forward edge of the bottom surface of said hopper is provided with a lip for supporting said leading edge of said single sheet.

3. The dispenser of claim 1, wherein said guide means comprises a finger, pivotal from an initial position around an axis to engage said leading edge and guide said leading edge toward said exit chute.

4. The dispenser of claim 3, wherein said guide means guides said leading edge into a nip portion formed between an opposed pair of feed rollers for assisting transport of said sheet through said exit chute said pair of feed rollers comprising an upper feed roller and a lower feed roller.

5. The dispenser of claim 1, wherein said main cam comprises: (a) a high point lobe which is capable of moving said separating means into contact with said single sheet; and (b) an intermediate portion which retracts said separating means from said hopper thereby removing said leading edge of said single sheet from said hopper and causes the pivoting of said guide means such that it engages and guides said leading edge toward said exit chute.

6. The dispenser of claim 4, wherein rotation of said main cam first raises said separating means to contact said bottom sheet, and further rotation of said main cam sequentially (a) lowers said separating means to separate said leading edge of said single sheet from said stack, (b) pivots said finger of said guide means to engage and guide said leading edge toward said nip portion of said pair of feed rollers, and (c) pivots said upper feed roller toward said sheet and over said leading edge of said single sheet to firmly grasp said leading edge between said pair of feed rollers.

7. The dispenser of claim 1 further comprising:

(a) a first cam follower provided on a first end of a first arm, said first arm being pivotal about a first pivot point;

(b) a second arm pivotably attached to said first arm, wherein said separating means is provided on an end of said second arm distal from said first arm;

(c) a third arm, a central portion of which is pivotably attached to said device proximal said hopper, and wherein one end of said third arm is pivotably attached to a middle portion of said second arm, to provide a second pivot point, and (d) a return spring attached to said first arm;

wherein rotation of said main cam causes a high lobe of said main cam to contact said cam follower causing said first arm to pivot around said first pivot point to move said second arm toward said hopper and pivot said separating means around said second pivot point into contact with said single sheet, against the force of said return spring.

8. The device of claim 6, further comprising:

(a) a second cam follower provided on an exit roller arm, said arm being pivotal around a third pivot point;

(b) a quarter section gear attached to said exit roller arm between ends of said arm;

(c) a feed roller gear mounted on a frame pivotal around a fourth pivot point, said gear being enmeshed with said quarter section gear; and (d) an upper pressure roller return spring attached to said exit roller arm;

wherein said upper pressure roller is mounted on said frame and rotation of said main cam causes a high lobe of said main cam to contact said exit roller arm to pivot said arm around said third pivot point simultaneously rotating and pivoting said frame around said fourth pivot point via said feed roller gear and said quarter section gear to pivot said upper pressure roller toward said sheet and over said leading edge of said sheet, against the force of said upper pressure roller return spring.

9. An automated sheet dispenser for dispensing a single sheet removed from the bottom of a stack formed of a plurality of sheets, said dispenser comprising:

a hopper for supporting the stack of sheets, said hopper having an opening provided in the bottom surface thereof to allow passage of a sheet through said opening;

a separating means for separating a leading edge of said single sheet from said stack through said opening and moving said leading edge to a position below said hopper;

a pair of feed rollers comprising an upper feed roller and a lower feed roller arranged to define a nip portion;

a guide means rotatable about a pivot for engaging said leading edge of said single sheet separated from said stack by said separating means, and for guiding said single sheet to said nip portion, whereby said feed rollers are operable to feed said single sheet to a sheet exit chute; and a main cam operatively engaged with said separating means and said guide means which lowers said separating means from the stack to separate said leading edge of said single sheet and pivots said guide means to engage said leading edge of said single sheet.

10. The dispenser of claim 9, wherein rotation of said main cam first raises said separating means to contact said bottom sheet, and further rotation of said main cam sequentially (a) lowers said separating means to separate said leading edge of said single sheet from said stack, (b) pivots said finger of said guide means to engage and guide said leading edge toward said nip portion of said pair of feed rollers, and (c) pivots said upper feed roller toward said sheet and over said leading edge of said single sheet to firmly grasp said leading edge between said pair of feed rollers.

11. The dispenser of claim 9 further comprising:

(a) a first cam follower provided on a first end of a first arm, said first arm being pivotal about a first pivot point;

(b) a second arm pivotably attached to said first arm, wherein said separating means is provided on an end of said second arm distal from said first arm;

(c) a third arm, a central portion of which is pivotably attached to said device proximal said hopper, and wherein one end of said third arm is pivotably attached to a middle portion of said second arm, to provide a second pivot point, and (d) a return spring attached to said first arm;

wherein rotation of said main cam causes a high lobe of said main cam to contact said cam follower causing said first arm to pivot around said first pivot point to move said second arm toward said hopper and pivot said separating means around said second pivot point into contact with said single sheet, against the force of said return spring.

12. The device of claim 11, further comprising:

(a) a second cam follower provided on an exit roller arm, said arm being pivotal around a third pivot point;

(b) a quarter section gear attached to said exit roller arm between ends of said arm;

(c) a feed roller gear mounted on a frame pivotal around a fourth pivot point, said gear being enmeshed with said quarter section gear; and (d) an upper pressure roller return spring attached to said exit roller arm;

wherein said upper pressure roller is mounted on said frame and rotation of said main cam causes a high lobe of said main cam to contact said exit roller arm to pivot said arm around said third pivot point simultaneously rotating and pivoting said frame around said fourth pivot point via said feed roller gear and said quarter section gear to pivot said upper pressure roller toward said sheet and over said leading edge of said sheet, against the force of said upper pressure roller return spring.

* * * * *